US011588303B2

(12) United States Patent
Gruber et al.

(10) Patent No.: US 11,588,303 B2
(45) Date of Patent: Feb. 21, 2023

(54) APPARATUS FOR IGNITING A FUEL MIXTURE, TRANSMISSION ELEMENT FOR TRANSMITTING A HIGH-VOLTAGE IGNITION VOLTAGE, IGNITION DEVICE, AND CIRCUIT DEVICE

(71) Applicant: Rosenberger Hochfrequenztechnik GmbH & Co. KG, Fridolfing (DE)

(72) Inventors: Andreas Gruber, Ainring (DE); Martin Fuchs, Freilassing (DE); Gunnar Armbrecht, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 69 days.

(21) Appl. No.: 17/261,425

(22) PCT Filed: Jul. 26, 2019

(86) PCT No.: PCT/EP2019/070267
§ 371 (c)(1),
(2) Date: Jan. 19, 2021

(87) PCT Pub. No.: WO2020/021105
PCT Pub. Date: Jan. 30, 2020

(65) Prior Publication Data

US 2021/0305787 A1 Sep. 30, 2021

(30) Foreign Application Priority Data

Jul. 27, 2018 (DE) ..... 10 2018 118 262.7

(51) Int. Cl.
*H01T 13/05* (2006.01)
*F02P 13/00* (2006.01)
*H01T 13/38* (2006.01)

(52) U.S. Cl.
CPC ..... *H01T 13/05* (2013.01); *F02P 13/00* (2013.01); *H01T 13/38* (2013.01)

(58) Field of Classification Search
CPC ..... H01T 13/05; H01T 13/38; H01T 13/06; H01T 13/34; H01T 13/36; H01T 13/20; H01T 13/41; F02P 13/00; F02P 3/02
See application file for complete search history.

(56) References Cited

U.S. PATENT DOCUMENTS 3,686,607 A 8/1972 Berry
3,965,879 A 6/1976 Fitzner
(Continued)

FOREIGN PATENT DOCUMENTS

DE 102004056991 A1 6/2006
GB 1296195 A 11/1972
JP 2008175197 A 7/2008

OTHER PUBLICATIONS

German Search Report dated Apr. 26, 2019.
(Continued)

*Primary Examiner* — Jacob M Amick
(74) *Attorney, Agent, or Firm* — Randall Danskin P.S.

(57) ABSTRACT

An apparatus for igniting a fuel mixture provides an ignition system for generating a high-voltage ignition voltage, a circuit device comprising a circuit for superimposing a high-frequency signal on to the high-voltage ignition voltage, a spark plug in an engine block, and a transmission element having a high-voltage conductor which is guided in an insulation element. The high-voltage conductor is used for transmitting the ignition voltage, onto which the high-frequency signal has been superimposed, to the spark plug. Further provided is an electrically conducting shielding element which surrounds the high-voltage conductor in an electromagnetically shielding manner at least along one portion of the longitudinal axis of the high-voltage conduc-
(Continued)

tor. The shielding element is connected in an electrically conducting manner to a ground potential of the circuit device and establishes a connection between the ground potential of the circuit device and a ground electrode of the spark plug.

28 Claims, 5 Drawing Sheets

(56) References Cited

U.S. PATENT DOCUMENTS

| | | | | |
|---|---|---|---|---|
| 4,327,702 | A * | 5/1982 | Imai | H01T 13/50 123/655 |
| 7,387,115 | B1 | 6/2008 | Katoh et al. | |
| 9,617,966 | B2 | 4/2017 | Armbrecht et al. | |
| 2002/0129950 | A1 | 9/2002 | Funk et al. | |
| 2004/0079139 | A1 | 4/2004 | Hiramatsu | |
| 2011/0117771 | A1 | 5/2011 | Poe | |
| 2013/0146325 | A1 | 6/2013 | Kenworthy et al. | |

OTHER PUBLICATIONS

International Search Report dated Oct. 16, 2019.
Miscellaneous PCT Documents PCT/EP2019/070267.
Office Action issued by the State Intellectual Property Office of China dated Dec. 28, 2021.

* cited by examiner

APPARATUS FOR IGNITING A FUEL MIXTURE, TRANSMISSION ELEMENT FOR TRANSMITTING A HIGH-VOLTAGE IGNITION VOLTAGE, IGNITION DEVICE, AND CIRCUIT DEVICE

RELATED APPLICATIONS

This US National Phase patent application claims priority to German Patent Application No. 10 2018 118 262.7 which was filed on 27 Jul. 2018, and also claims priority to PCT/EP2019/070267 which was filed on 26 Jul. 2019 and which was published as WO 2020/201105 A1 on 30 Jan. 2020. The entire contents of each of the aforementioned patent applications is expressly and fully incorporated herein by this reference. This claim of priority is also being made and set forth in the Application Data Sheet (ADS) filed contemporaneously herewith.

BACKGROUND

The invention relates to an apparatus for igniting a fuel mixture, in particular a fuel-air mixture, with an ignition system for generating a high ignition voltage and with a spark plug arranged in an engine block and a transmission element having a high-voltage conductor which is guided in an insulation element for transmission of the ignition voltage to the spark plug.

The invention also relates to a transmission element for transmitting a high ignition voltage from an ignition system to a spark plug, having a high-voltage conductor which is guided in an insulation element.

The invention also relates to an ignition device for generating a high ignition voltage. The invention also relates to a circuit device.

Apparatuses for igniting a fuel mixture, in particular a fuel-air mixture, are known in various designs from the prior art. The aim is to further improve the combustion process in the combustion chamber of the engine, in particular in an internal combustion engine with spark ignition by spark plugs, also known as a gasoline engine.

The fuel-air mixture introduced into the combustion chamber, or a cylinder, is usually compressed by a piston moving in the combustion chamber. Shortly before top dead center is reached, a spark from a spark plug ignites the fuel-air mixture.

It is known from the prior art that an ignition system or an ignition coil transforms a battery voltage of a vehicle to the desired ignition voltage in order to provide a high ignition voltage. The ignition voltage is then applied to the spark plug via an ignition cable or a high-voltage conductor.

Spark plugs of different designs are known from the general prior art. The ignition voltage is usually applied via a connecting bolt, which is insulated from the outside, for example via a plug insulator, in order to provide the ignition voltage at a so-called center electrode. The ignition spark then jumps over from the center electrode to a ground electrode and thereby overcomes the spark gap or the distance between the two electrodes. The ground electrode is usually electrically conductive, mostly connected to the engine block or the cylinder head via a screw thread.

The high-voltage conductor, which transmits the high ignition voltage from the ignition system to the spark plug, is usually guided in an insulation element which encompasses or surrounds the high-voltage conductor on the outside.

It is also known from the prior art to ignite a fuel-air mixture with a high-frequency plasma ignition apparatus as an alternative to generating a high ignition voltage.

For this purpose, reference is made to DE 20 2012 004 602 U1, for example, which describes a high-frequency plasma ignition apparatus for an internal combustion engine, in particular for igniting a fuel-air mixture in a combustion chamber of an internal combustion engine using a series resonant circuit.

The automotive industry and its suppliers and research institutes are working intensively on further improving the combustion process, especially in gasoline engines.

The present invention is based on the object of further improving a device for igniting a fuel mixture with an ignition system for generating a high ignition voltage and a spark plug arranged in an engine block in order to further optimize the combustion process, in particular in a gasoline engine.

The present invention is also based on the object of providing an improved transmission element for transmitting a high ignition voltage from an ignition system to a spark plug.

The present invention is also based on the object of providing an ignition device for generating a high ignition voltage in order to further improve the ignition of a fuel mixture in a combustion chamber of an internal combustion engine in order to further optimize the combustion process, in particular in a gasoline engine.

Furthermore, the present invention is based on the object of providing a circuit device which makes it possible to further improve the ignition of a fuel mixture in a combustion chamber of an internal combustion engine in order to further optimize the combustion process, in particular in a gasoline engine.

According to the invention, the apparatus for igniting a fuel mixture, in particular a fuel-air mixture, has an ignition system for generating a high ignition voltage and a circuit device comprising a circuit for superimposing a high-frequency signal on the high ignition voltage. The apparatus further comprises a spark plug arranged in an engine block and a transmission element having a high-voltage conductor, which is guided in an insulation element, for transmitting the high ignition voltage on which the high-frequency signal is superimposed to the spark plug.

The spark plug is preferably located in a shaft within the metal engine block.

The apparatus can optionally also have a plurality of spark plugs and correspondingly a plurality of transmission elements.

An electrically conductive shielding element is also provided, which encompasses the high-voltage conductor in an electromagnetically shielding manner at least along a section of its longitudinal axis, the shielding element being electrically conductively connected to a ground potential of the circuit device and the shielding element establishing a connection between the ground potential of the circuit device and a ground electrode of the spark plug.

In the apparatus according to the invention, a high-frequency signal is superimposed on the high ignition voltage (HV pulse) generated by the ignition system.

The high frequency signal can be generated by a high frequency generator. High-frequency generators for generating a high-frequency signal are known from the prior art.

Within the scope of the invention, the high-frequency signal can be generated by the circuit device, but also externally, and transmitted to the circuit device, in particular to the circuit of the circuit device.

The fact that a high-frequency signal is superimposed on the high ignition voltage results in advantageous combustion in the combustion chamber of the internal combustion engine by means of an ignition spark and a subsequent plasma process.

The high ignition voltage or the high-voltage pulse (hereinafter also referred to as HV pulse) and the superimposed high-frequency signal (hereinafter also referred to as HF signal) can be generated in a common circuit device. In principle, however, it is also possible to generate the high ignition voltage and/or the high-frequency signal separately and to supply them/it to the circuit device or to superimpose the high-frequency signal on the high ignition voltage in the circuit device.

The coupling or superimposing of the high ignition voltage can be carried out using methods that are known in principle.

The high ignition voltage can preferably be generated using an ignition coil.

The ignition coil and the means for coupling a high-frequency signal into the high ignition voltage can be embodied as parts of the circuit device. The high ignition voltage can, however, also be generated outside of the circuit device and transmitted to the circuit device, for example, by a cable or a (high-voltage) supply line.

According to the invention, the circuit device thus has a circuit for superimposing a high-frequency signal on the high ignition voltage. In order to be able to carry out the combustion process by igniting the fuel mixture by means of the high ignition voltage and the high-frequency signal superimposed on it, the apparatus has the transmission element already mentioned. The transmission element has a high-voltage conductor which is guided in an insulation element. The electrically conductive shielding element then encompasses the high-voltage conductor in an electromagnetically shielding manner at least along a section of its longitudinal axis. Furthermore, the shielding element is connected, in an electrically conductive manner, to a ground potential of the circuit device and the shielding element establishes a connection between the ground potential of the circuit device and a ground electrode of the spark plug.

The inventors have recognized that, for it to be possible to inject the combustion process in a gasoline engine by means of a high ignition voltage on which a high-frequency signal is superimposed, it can be essential firstly to shield the high-voltage conductor and secondly to establish a connection between the ground potential of the circuit device and the ground electrode of the spark plug. The shielding element also shields the ignition pulse consisting of the high ignition voltage and the superimposed high-frequency signal from external interference. Furthermore, it can be advantageous to shield the ignition pulse in such a way that it does not influence adjacent electronics, in particular so as not to interfere with the sensitive electronics, for example in a motor vehicle, or to impair them as little as possible.

Furthermore, the inventors have found that the combustion process is optimized by virtue of the fact that the ground potential of the circuit device and the ground electrode of the spark plug are electrically connected to one another.

In the following, the ground potential is also referred to as "ground" for the sake of simplicity.

It is advantageous if the shielding element produces a potential equalization between the ground electrode of the spark plug and the circuit device.

The shielding element according to the invention prevents or reduces both electromagnetic radiation from the high-voltage conductor and electromagnetic radiation into the high-voltage conductor.

The shielding element according to the invention enables good electromagnetic compatibility (EMC), which means that optimized combustion is reliably possible by means of a high ignition voltage with a superimposed high-frequency signal.

The shielding element preferably completely surrounds the high-voltage conductor along a section of its longitudinal axis. However, it is also possible, in particular to ensure good mobility of the high-voltage conductor or of the transmission element, that the shielding element has expansion joints, recesses, gaps, incisions or notches in order to permit movement of the high-voltage conductor or of the transmission element in a radial and/or axial manner, in particular for tolerance compensation.

The term shielding element is in particular not to be understood in such a way that the shielding has to take place in a completely closed fashion along the axial section. Nevertheless, it is provided in a particularly preferred embodiment that the shielding element encloses the high-voltage conductor completely or in a closed fashion along at least a section of its axial length or along at least a section of its longitudinal axis.

According to the invention it can be provided that the shielding element encompasses the insulation element, on the outside, at least along a section of its longitudinal axis.

This solution has proven to be particularly suitable. The shielding element is preferably embodied in such a way that it encompasses the high-voltage conductor in that the shielding element surrounds or encases the insulation element, which receives the high-voltage conductor, on the outside.

The shielding element can be embodied as described above in order to ensure radial mobility. Preferably, however, the shielding element encompasses or surrounds the insulation element completely or in a circumferentially closed fashion along the axial section.

It can be advantageous if the circuit device comprises a circuit housing which electromagnetically shields the circuit.

Because the circuit device comprises a circuit housing which accommodates the circuit and shields it electromagnetically, i.e. electrically and/or magnetically, the high ignition voltage on which the high-frequency signal is superimposed is shielded within the circuit device in a particularly suitable manner.

According to the invention, it can be provided that the shielding element is connected to a ground potential of the circuit housing and/or a ground potential of the circuit. It is particularly preferable if the ground potential of the circuit is connected to the ground potential of the circuit housing. Furthermore, it is preferable, in particular for this embodiment, that the shielding element is connected to the ground potential of the circuit housing. The circuit housing can preferably have a through-hole into which the shielding element is inserted.

The shielding element is preferably embodied as part of the transmission element.

It can be advantageous if the insulation element is made of rubber or a rubber-like material.

This configuration initially has the advantage that the insulation element can also perform the function of a seal or can perform a sealing function. The insulation element can seal a grilled hole or a connection with the circuit device, in particular the circuit housing, and a connection with the engine block, in particular a shaft in the engine block or a connection point with a cylinder head.

The configuration of the insulation element from rubber or a rubber-like material also has the advantage that the insulation element can compensate for at least slight radial movements.

The insulation element is preferably embodied as a jacket that surrounds the high-voltage conductor in a close-fitting manner or at a distance, for example in such a way that a tubular passage is formed in the jacket. Such a configuration is suitable both when the insulation element is made of rubber or a rubber-like material or also of another insulating material.

According to the invention it can be provided that the shielding element only surrounds or encases a section of the longitudinal axis of the insulation element on the outside.

It can be advantageous if the shielding element extends as far as the engine block in order to establish an electrical connection between the ground potential of the circuit device, in particular the circuit housing and the circuit, and the ground electrode of the spark plug via the engine block.

Such a configuration can be achieved particularly advantageously in that the shielding element comprises only a section of the longitudinal axis of the shielding element. The axial section preferably begins at a first end of the insulation element, which is preferably connected to the circuit housing, and extends in the direction of the second end of the insulation element, preferably in such a way that an electrical connection is established between the ground potential of the circuit housing and the engine block.

In a further development of the invention, it can also be provided that starting from a first end of the insulation element, the shielding element only encompasses a section of the longitudinal axis of the insulation element on the outside, with a ground conductor extending to a second end of the insulation element facing the spark plug.

This solution has the advantage that on the one hand good shielding, in particular shielding to improve the EMC, is provided in the area between the circuit device, in particular a circuit housing, and the engine block, but the connection between the ground potential of the circuit device and the ground electrode does not necessarily depend on the engine block. The ground line, which is continued up to a second end of the insulation element facing the spark plug, can in this case provide the electrical connection. This has the advantage that the engine block itself does not necessarily have to be connected to the spark plug. This increases the design freedom when configuring the shaft provided for the spark plug in the engine block.

In a further embodiment of the solution according to the invention it can be provided that the shielding element encompasses the insulation element on the outside from a first end to the second end. If necessary, it can be provided that the shielding element at the first and/or the second end is set back a little relative to the insulation element, preferably in such a way that at least 90%, preferably 95%, of the middle part of the insulation element is surrounded by the shielding element. In this embodiment, however, the insulation element is preferably surrounded by the shielding element over its entire (axial) length. An offset of the shielding element with respect to the insulation element can primarily be advantageous in order to enable suitable attachment of the transmission element or to avoid adversely affecting the sealing function of the insulation element.

According to the invention, it can be provided in particular that the shielding element or a ground conductor connected to the shielding element extends to the spark plug in order to establish an electrically conductive connection between the circuit device, in particular the circuit housing and the circuit, and the ground electrode of the spark plug directly via the spark plug.

The connection of the ground electrode to the circuit device, in particular a circuit housing, is thus possible independently of the engine block.

According to the invention it can be provided that the high-voltage conductor is embodied at least in sections or at least partially as an electrically conductive spring.

A configuration of the high-voltage conductor at least in sections, or partially as a spring, has the advantage that the high ignition voltage can be transmitted particularly advantageously and reliably with the superimposed high-frequency signal. The elasticity of the electrically conductive spring can compensate for manufacturing tolerances in the longitudinal direction of the spring. Furthermore, the electrically conductive spring can also compensate for different angles of an angled shaft in the engine block into which the transmission element is inserted. However, the use of an electrically conductive spring is also suitable when the shaft in which the transmission element is received within the engine block does not run at an angle. An angled course of the shaft in the engine block is basically optional, but can be particularly suitable.

The electrically conductive spring is preferably guided in a grilled hole in the insulation element, preferably in a configuration with a sealing function, in particular in an insulation element made of rubber. The electrically conductive spring can, however, also be guided within the insulation element in a different manner.

Making the insulation element from rubber, or a rubber-like material, and embodying the high-voltage conductor as a spring permits in a particularly advantageous manner that manufacturing tolerances and angular deviations can be compensated. Furthermore, the transmission element thus formed is particularly elastic or has an elasticity that is advantageous for the intended use.

In addition to the sealing function, in particular in the junction with the circuit housing and in the junction with the engine block, the insulation element advantageously also performs the function of providing electrical insulation between the electrically conductive spring and the engine block or the circuit housing.

The configuration according to the invention makes it possible to transmit the high ignition voltage on which the high-frequency signal is superimposed via the electrically conductive spring to the spark plug, in particular a center electrode of the spark plug, while the ground electrode of the spark plug to which the spark jumps from the center electrode is particularly advantageously connected to the ground potential of the circuit device, in particular the circuit housing and the circuit. This configuration enables the advantageous use of a high ignition voltage with a superimposed high-frequency signal in order to optimize the combustion process in a combustion chamber.

The electrically conductive spring can preferably be embodied and arranged in such a way that it presses against a suitable coupling unit of the spark plug.

The solution according to the invention enables an advantageous ground connection of the circuit device, which can have an ignition coil, to the cylinder head of a cylinder of an internal combustion engine.

According to the invention it can be provided that the shielding element is at least partially formed by metallization or a coating of the insulation element.

It can be advantageous if the coating, or metallization, of the insulation element takes place at least between the circuit device, in particular the circuit housing, and the engine block. Metallization, or a coating, has the advantage that it can be implemented easily and reliably. A risk that the metallization or the coating of the insulation element could become brittle due to excessive expansion or bending, or due to aging, can possibly be reduced by the metallization or the coating having gaps.

According to the invention it can be provided that the insulation element has at least one recess or depression that is not provided with metallization or a coating and/or that the metallization has gaps so that non-metallized areas are formed on the surface of the insulation element.

Embodying the insulation element with recesses or depressions, preferably groove-shaped recesses, has the advantage that metallization or a coating can be applied to the outside of the insulation element in a simple manner such that no coating is formed in the recesses. This significantly reduces the brittleness of the metallization or the coating.

The coating is preferably a metallic coating. This is particularly suitable for producing an electrically conductive connection and also shielding.

In one embodiment of the invention, it can be provided that the metallization or the coating extends over the entire (axial) length of the insulation element, for which reference is made to the above explanations, designs and options. If necessary, one or more gaps or recesses can be provided, in particular such that the electrical connection between the circuit housing and the spark plug or the ground electrode of the spark plug is not interrupted.

Because the insulation element has at least one recess or depression, preferably a plurality of recesses or depressions, which extend in the radial or axial direction, possibly also with a curved course, preferably in the axial direction, the elasticity of the shielding element and thus also of the transmission element can be influenced in a targeted fashion.

In one configuration of the solution according to the invention it can also be provided that the shielding element is embodied as a spring band which is wound into the shape of a sleeve. A spring band wound into the shape of a sleeve is also known as an evolute spring. A double evolute spring can also be used. Embodying the shielding element as an evolute spring constitutes a particularly suitable solution with which good shielding of the high-frequency signal can be achieved.

The shielding element embodied as an evolute spring preferably extends only over part of the length of the insulation element, preferably in such a way that a distance between the circuit device, in particular the circuit housing, and the engine block is shielded.

Evolute springs are also known as buffer springs, spiral springs or truncated cone springs. The embodiments known in this regard are also suitable for embodying the shielding element. With regard to further configurations and variants, reference is made to the above statements.

The shielding element can also be embodied as a contact spring.

In a further embodiment of the invention it can also be provided that the shielding element is at least partially embodied as a torsion spring.

Embodying the shielding element as a torsion spring can also have advantages. With regard to the shielding of the high-frequency signal, however, disadvantages can result from the fact that slits may arise between the individual turns of the torsion spring when the tension is high.

The shielding element embodied as a torsion spring preferably extends between the circuit device, in particular the circuit housing, and the engine block.

The designs and variants already described can also be used with the torsion spring.

According to the invention it can further be provided that the shielding element is at least partially embodied as a spring cage and/or as a spring sleeve.

The configuration as a "lampion-shaped" spring cage, i.e. with a bulge in the central axial area, is particularly suitable. The shielding element formed by the spring cage preferably extends between the circuit device, in particular a circuit housing, and the engine block.

The electrically conductive spring can also be embodied as a contact spring in any design.

In a further embodiment of the invention it can also be provided that the shielding element is at least partially embodied as a closed metal sleeve and/or that the shielding element is at least partially designed as a metal sleeve and/or spring sleeve with recesses.

Embodiment as a metal sleeve with a recess, in particular with punchings, has been found to be particularly suitable for specifically influencing the elasticity of the shielding element.

The shielding element designed as a metal sleeve is preferably positioned between the circuit housing and the engine block.

In principle, it is possible for the shielding element to be formed from a combination of two or more of the variants presented herein. For example, the shielding element can be partially embodied as an evolute spring, in particular between the circuit housing and the engine block, while the shielding element is embodied as a metallic coating in the direction of the second end of the insulation element facing the spark plug. Any combinations that make sense for the particular use are possible and are contemplated within the scope of the invention.

The shielding element according to the invention can be designed in such a way that the high ignition voltage can be transmitted with the superimposed high-frequency signal without having to use interference suppression resistors.

The invention also relates to a transmission element for transmitting a high ignition voltage from an ignition system to a spark plug, having a high-voltage conductor which is guided in an insulation element. The high-voltage conductor is at least partially embodied as a spring. The transmission element has an electrically conductive shielding element which electromagnetically shields the spring at least along a section of its longitudinal axis, wherein the shielding element is arranged and embodied in such a way that the shielding element comprises at least a section of the longitudinal axis of the insulation element on the outside.

In the context of the transmission element according to the invention it is preferably provided that the high-voltage conductor is embodied entirely as a spring. The shielding element preferably includes the electrically conductive spring, as has already been stated above with regard to the high-voltage conductor or the electrically conductive spring in the context of the apparatus according to the invention.

The shielding element preferably comprises the spring outside the circuit housing, preferably up to an engine block and possibly also up to contact with the spark plug. The shielding element preferably also shields the junction areas with the circuit housing and the engine block. Shielding by the shielding element within the circuit housing is generally not additionally necessary.

The high ignition voltage to be transmitted is preferably a high ignition voltage on which a high-frequency signal is superimposed, preferably such as has already been explained with regard to the apparatus according to the invention.

The invention also relates to an ignition device comprising: an ignition system for generating a high ignition voltage; a circuit device comprising a circuit for superimposing the high ignition voltage with a high-frequency signal; and a transmission element in the configuration and with the variants that have already been described above, in order to transmit the high ignition voltage on which the high-frequency signal is superimposed to a spark plug.

The invention also relates to a circuit device for superimposing a high-frequency signal on a high ignition voltage, and with a transmission element with the variants and configurations that have already been described above in order to transmit the high ignition voltage on which the high-frequency signal is superimposed to the spark plug.

Features that have already been described in connection with the apparatus according to the invention for igniting a fuel mixture can of course also be applied accordingly to the transmission element, the ignition device and the circuit device—and vice versa. Furthermore, advantages that have already been mentioned in connection with the operator according to the invention for igniting a fuel mixture can also be understood to relate to the transmission element, the ignition device and the circuit device—and vice versa.

It is noted that expressions such as "comprising", "having" or "with" do not exclude any other features or steps. Furthermore, expressions such as "a", "an" or "the" which refer to a single number of steps or features do not exclude a plurality of features or steps, and vice versa.

SUMMARY

A principal aspect of the present invention is an apparatus for igniting a fuel mixture and generally provides an ignition system for generating a high ignition voltage; a circuit device having a circuit for superimposing the high ignition voltage with a high-frequency signal; a spark plug having a ground electrode and operatively communicating with an engine block; a transmission element which is guided in an insulation element, the transmission element encompassing a high-voltage conductor for transmitting the high ignition voltage, superimposed with the high-frequency signal, to the spark plug, and wherein an electrically conductive shielding element is provided, and the electrically conductive shielding element encompasses the high-voltage conductor at least along a section of the high-voltage conductor longitudinal axis in an electromagnetic shielding manner; and wherein the electrically conductive shielding element is electrically conductively connected to a ground potential of the circuit device; and the electrically conductive shielding element establishes an electrical connection between the ground potential of the circuit device and the ground electrode of the spark plug.

A second aspect of the present invention is an apparatus wherein the electrically conductive shielding element encompasses the insulation element on the outside of the high-voltage conductor at least along a section of the high-voltage conductor longitudinal axis.

A further aspect of the present invention is an apparatus further comprising a circuit housing which electromagnetically shields the circuit.

A further aspect of the present invention is an apparatus wherein the electrically conductive shielding element is connected to at least one of a ground potential of the circuit housing and a ground potential of the circuit.

A further aspect of the present invention is an apparatus wherein the ground potential of the circuit is connected to the ground potential of the circuit housing.

A further aspect of the present invention is an apparatus wherein the high-voltage conductor is a spring.

A further aspect of the present invention is an apparatus wherein the insulation element is made of at least one of rubber, and a rubber-like material.

A further aspect of the present invention is an apparatus wherein the electrically conductive shielding element is formed by metallizing the insulation element.

A further aspect of the present invention is an apparatus wherein the electrically conductive shielding element extends to the engine block to establish an electrical connection between the ground potential of the circuit device and the ground electrode of the spark plug via the engine block.

A further aspect of the present invention is an apparatus wherein at least one of the electrically conductive shielding element and a ground conductor connected to the electrically conductive shielding element extend to the spark plug to establish an electrically conductive connection between the circuit device and the ground electrode of the spark plug via the spark plug.

A further aspect of the present invention is a transmission element for transmitting a high ignition voltage from an ignition system to a spark plug, comprising: a high-voltage conductor which is guided in an insulation element and wherein the high-voltage conductor is at least partially an electrically conductive spring that has a longitudinal axis; an electrically conductive shielding element which encompasses the electrically conductive spring in an electromagnetic shielding manner along a section of the electrically conductive spring's longitudinal axis; and wherein the electrically conductive shielding element is arranged and embodied so that the electrically conductive shielding element encompasses at least a portion of a longitudinal axis of the insulation element on an outside of the insulation element.

A further aspect of the present invention is a transmission element wherein the insulation element is made of at least one of rubber, and a rubber-like material.

A further aspect of the present invention is a transmission element wherein the electrically conductive shielding element encompasses only a section of the longitudinal axis of the insulation element on the outside or the electrically conductive shielding element, and starting from a first end of the insulation element.

A further aspect of the present invention is a transmission element wherein the electrically conductive shielding element is at least partially formed by metallization of the insulation element, or a coating of the insulation element.

A further aspect of the present invention is a transmission element wherein the insulation element has at least one recess, or at least one depression, that is not metalized or coated, so that at least one of non-metallized/non-coated recesses/depressions are formed on the surface of the insulation element.

A further aspect of the present invention is a transmission element wherein the electrically conductive shielding element is at least partially a spring band which is wound in a sleeve shape.

A further aspect of the present invention is a transmission element wherein the electrically conductive shielding element is at least partially a torsion spring.

A further aspect of the present invention is a transmission element wherein the electrically conductive shielding element is at least partially a spring cage and/or a spring sleeve.

A further aspect of the present invention is a transmission element wherein the electrically conductive shielding element is at least partially a closed metal sleeve.

A further aspect of the present invention is an ignition device for generating a high ignition voltage, comprising a circuit device having a circuit for superimposing a high-frequency signal on the high ignition voltage; and a transmission element to transmit the high ignition voltage on which the high-frequency signal is superimposed to a spark plug.

A further aspect of the present invention is a circuit device for superimposing a high-frequency signal on a high ignition voltage, comprising a transmission element that has, a high-voltage conductor which is guided in an insulation element, and wherein the high-voltage conductor is an electrically conductive spring that has a longitudinal axis, and an electrically conductive shielding element which encompasses the electrically conductive spring in an electromagnetic shielding manner along a section of the electrically conductive spring's longitudinal axis, and wherein the electrically conductive shielding element encompasses at least a portion of a longitudinal axis of the insulation element and on an outside of the insulation element; and the high-voltage conductor transmits the high ignition voltage on which the high-frequency signal is superimposed to the spark plug.

A further aspect of the present invention is an apparatus wherein the electrically conductive shielding element is a spring band.

A further aspect of the present invention is an apparatus wherein the electrically conductive shielding element is wound in a sleeve shape.

A further aspect of the present invention is an apparatus wherein the electrically conductive shielding element is wound as a torsion spring.

A further aspect of the present invention is an apparatus wherein the electrically conductive shielding element is formed by metallizing the insulation element and may also be in the form of a spring cage.

A further aspect of the present invention is an apparatus wherein the electrically conductive shielding element is a spring sleeve, and may further be in the form of a metal sleeve.

A further aspect of the present invention is a transmission element wherein the electrically conductive shielding element encompasses only a section of the longitudinal axis of the insulation element on the outside of the insulation element, and wherein a ground conductor is continued up to a second end of the insulation element proximate to the spark plug.

A further aspect of the present invention is a transmission element wherein the electrically conductive shielding element encompasses the insulation element from a first end up to a second end on the outside of the insulation element.

A further aspect of the present invention is a transmission element wherein the electrically conductive shielding element is at least partially at least one of a metal sleeve and a spring sleeve with recesses.

These and other aspects of the present invention are set forth in the written description herein.

BRIEF DESCRIPTIONS OF THE DRAWINGS

An exemplary embodiment of the invention will be described in greater detail below with reference to the drawings.

The figures show a preferred exemplary embodiment in which individual features of the present invention are illustrated in combination with one another. However, the features of the exemplary embodiment can also be implemented in isolation from the other features of the exemplary embodiment and can accordingly be readily combined by a person skilled in the art to form further expedient combinations and sub-combinations.

DETAILED WRITTEN DESCRIPTION OF THE PREFERRED EMBODIMENTS

The basic principle, and the basic mode of functioning of an internal combustion engine, in particular an internal combustion engine of a motor vehicle, and the associated apparatus for igniting a fuel-air mixture in a combustion chamber, in particular a cylinder of the engine, are well known from the general prior art. In particular, internal combustion engines with external ignition by spark plugs, so-called Otto engines, in particular also with direct injection, are known.

The generation of a high ignition voltage using an ignition system that transforms a battery voltage to a required ignition voltage is also known in principle. The generation of a high-frequency signal, in particular a high-frequency plasma ignition device for igniting a fuel-air mixture in a combustion chamber of an internal combustion engine, is also known in principle, for which reference is also made to DE 20 2012 004 602 U1.

Figure 1:
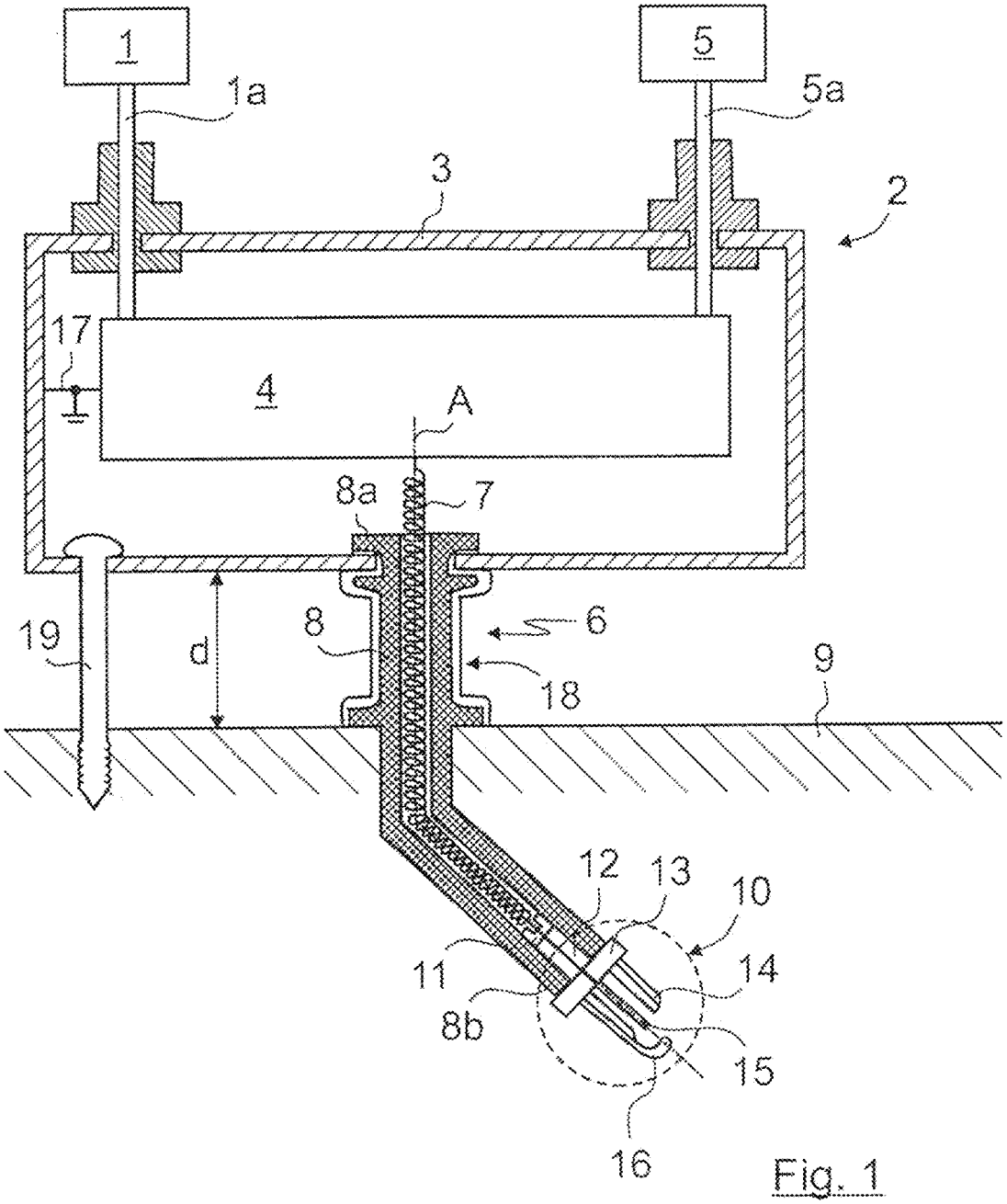
FIG. 1 is an illustration of the invention with a cross-sectional illustration of a circuit housing of a circuit device and a transmission element.

FIG. 1 shows an apparatus for igniting a fuel mixture, in particular a fuel-air mixture, with an ignition system 1, shown only in a basic form, for generating a high ignition voltage (HV pulse) and a circuit device 2.

In the exemplary embodiment, the circuit device 2 comprises a circuit housing 3 and a circuit 4 for superimposing a high-frequency signal (HF signal) on the high ignition voltage. In the exemplary embodiment, the high-frequency signal is generated by means of a high-frequency generator 5. The high-frequency signal generated by the high-frequency generator 5 is fed to the circuit 4 via a high-frequency lead 5*a*. Accordingly, the high ignition voltage generated by the ignition system 1 is also fed to the circuit 4 via a high-voltage lead 1*a*.

Alternatively, the ignition system 1 and/or the high-frequency generator 5 and/or another apparatus for generating the high ignition voltage or the high-frequency signal can also be integrated into the circuit device 2, in particular into the circuit housing 3 and possibly also into the circuit 4.

The generation of the high ignition voltage or a corresponding high-voltage pulse and the high-frequency signal can in principle take place in any known manner within the scope of the invention.

A transmission element 6 is also provided, which has a high-voltage conductor 7 which is guided in an insulation element 8.

The high ignition voltage on which the high-frequency signal is superimposed by the circuit 4 is applied to the high-voltage conductor 7 of the transmission element 6.

Figure 8:
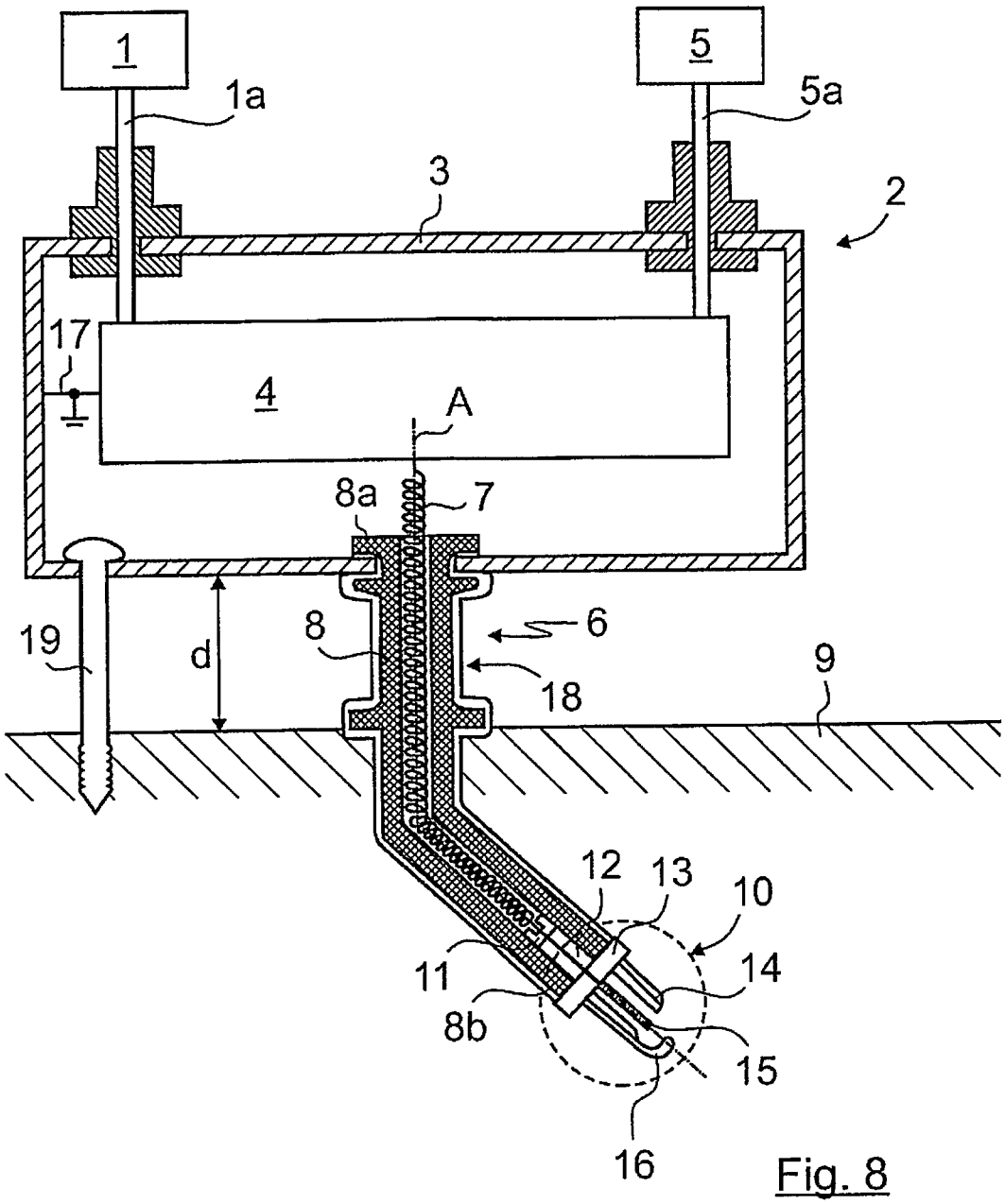
FIG. 8 shows a second contemplated embodiment of the apparatus of FIG. 1, in which a metallic coating of the insulation element extends from the circuit housing to a spark plug.

As can be seen from FIGS. 1 and 8, the transmission element 6 leads to a spark plug 10 arranged in an engine block 9.

The spark plug 10 can have any suitable design for igniting a fuel-air mixture. As can be seen from the basic illustration in FIGS. 1 and 8, the spark plug 10 in the exemplary embodiment has a metallic connection part 11, a ceramic part 12, a flange 13 with an integrated crimped ring for holding the ceramic part 12 in place, a screw-in thread 14, a center electrode 15 and a ground electrode 16.

The design of the spark plug 10 can also differ; in particular, instead of a center electrode 15 insulated by means of ceramic part 12, some other insulation can also be provided.

The design of spark plugs and the different variants are known from the prior art.

The spark plug 10 is located in a shaft of the engine block 9. The shaft in the engine block 9 does not have to run at an angle, as shown in the exemplary embodiments, but can have any desired course, possibly also a non-angled course.

According to the invention, due to the design of the transmission element 6, which is described in more detail below, it is possible to dispense with an interference suppression resistor integrated in the spark plug 10.

In the exemplary embodiment it is provided that the spark plug 10 is connected to the engine block 9 in an electrically conductive manner via the screw-in thread 14.

The circuit housing 3 is designed to be electrically conductive in the exemplary embodiments according to FIGS. 1 and 8, so that the circuit 4 is electromagnetically shielded. The circuit 4 can be connected to the circuit housing 3 via a ground line 17, so that the circuit housing 3 and the circuit 4 have the same ground potential.

In the exemplary embodiment, the high-voltage conductor 7 is embodied as a spring 7. However, the exemplary embodiment is not limited to this. The formation of the high-voltage conductor as a spring 7 is particularly suitable, however, in particular to compensate for tolerances.

The high-voltage conductor 7 can optionally also be embodied such that it is embodied as a spring only over part of its longitudinal axis A or (axial) length.

In the exemplary embodiment it is further provided that the insulation element 8 encompasses or encases the spring 7. This can preferably be achieved in that the insulation element 8 has a central grilled hole for receiving the spring 7.

The insulation element 8 is preferably made of rubber or a rubber-like material, but the exemplary embodiment is not limited to this.

In the exemplary embodiment, the insulation element 8 also fulfils the function of a sealing part or takes on a sealing function. In the exemplary embodiment it is provided that the insulation element 8 seals both the junction with the circuit housing 3 and the junction area with the engine block 9 so that no moisture can penetrate. For this purpose, the insulation element 8 can be designed accordingly, preferably having grooves, for example a wall of the circuit housing 3 and/or ring-shaped extensions for positive accommodation, as shown in a basic form in FIGS. 1 to 8.

As can be seen from the figures of the drawings, an electrically conductive shielding element 18 is provided or formed. The shielding element 18 encompasses and shields the spring 7 here, at least along a section of the longitudinal axis A of the spring 7.

In the exemplary embodiments according to FIGS. 1 to 7, it is shown that the shielding element 18 encompasses the spring 7 in an electromagnetically shielding manner only over part of the axial length or longitudinal axis A. The shielding element 18 is preferably designed in such a way that the shielding element 18 encompasses the spring 7 to such an extent that the distance d between the circuit housing 3 and the engine block 9 is shielded.

In the exemplary embodiment according to FIG. 8, it is provided that the shielding element 18 encompasses the spring 7 outside the circuit housing 3 up to the spark plug 10. This is to say the spring 7 is encompassed by the shielding element 18 outside the circuit housing almost over its entire length.

The shielding element 18 is connected in an electrically conductive manner to a ground or to the ground potential of the circuit device 2. The shielding element 18 establishes a connection between the ground of the circuit device 2 and the ground electrode 16 of the spark plug 10.

In the exemplary embodiment, the shielding element 18 is connected in an electrically conductive manner to the circuit housing 3 of the circuit device 2. The circuit housing 3 is connected to the circuit 4 via the ground line 17, as already described, so that the circuit 4, the circuit housing 3 and also the shielding element 18 have the same ground or the same ground potential.

In the exemplary embodiment, the shielding element 18 is embodied in such a way that it encompasses the insulation element 8 on the outside at least along a section of its longitudinal axis A.

The exemplary embodiments according to FIGS. 1 to 7 show that the shielding element 18 encompasses the insulation element 8 over a portion of the longitudinal axis A thereof. In the exemplary embodiment according to FIG. 8, it is provided that the shielding element 18 encompasses the insulation element 8 on the outside over the entire or at least approximately the entire (axial) length. As already described, the spring 7 is accordingly encompassed and shielded by the shielding element 18.

In the exemplary embodiments according to FIGS. 1 to 7 it is provided that the shielding element 18 extends as far as the engine block 9 in order to establish an electrical connection between the ground of the circuit device 2 and the ground electrode 16 via the engine block 9.

The alternative contemplated embodiment shown in FIG. 8 shows a variant in which it is provided that the shielding element 18 extends as far as the spark plug 10 in order to establish an electrically conductive connection to the ground electrode 16 of the spark plug 10 directly via the spark plug 10. The shielding element 18 is preferably connected to the crimped ring 13 and this in turn is connected to the ground electrode 16 via the screw-in thread 14.

In a manner not shown, as an alternative to the exemplary embodiments in FIGS. 1 to 8, a ground conductor connected to the shielding element 18 extends to the spark plug 10 in order to establish an electrically conductive connection to the ground electrode 16 of the spark plug 10 directly via the spark plug 10. In this case, the shielding element 18 does not have to be continued up to the spark plug 10, as shown in FIG. 8. The shielding can be provided within the engine block 9 by the engine block 9 or the correspondingly designed shaft for spark plugs 10, while the ground conductor (not shown) establishes a connection starting from the shielding element 18, preferably via the crimped ring 13 and the screw-in thread 14, with the ground electrode 16, is produced so that the ground electrode 16 has the same potential as the circuit device 2.

In the exemplary embodiments according to FIGS. 1 to 7, it is provided that, starting from a first end 8*a* of the insulation element 8, the shielding element 18 only encompasses or surrounds a portion of the longitudinal axis A of the insulation element 8 on the outside. As stated, a ground conductor (not shown in more detail) can optionally be extended to a second end 8*b* of the insulation element 8 facing the spark plug 10.

In the exemplary embodiment shown in FIG. 8, it is provided that the shielding element 18 extends from a first end 8*a* to a second end 8*b* of the insulation element 8.

As can also be seen from FIGS. 1 and 8, it can be provided that the circuit housing 3 is secured on the engine block 9. The area of the engine block 9 on which the circuit housing 3 is secured can be a cylinder head of the cylinder into which the spark plug 10 is inserted.

A fastening 19 for securing the circuit housing 3 is shown in a basic form in FIGS. 1 and 8.

In FIGS. 2 to 7, different embodiments of the shielding element 18 are shown, which can also be used in combination with one another for the embodiments shown in FIG. 1 as well as for those shown in a basic form in FIG. 8.

Figure 2:
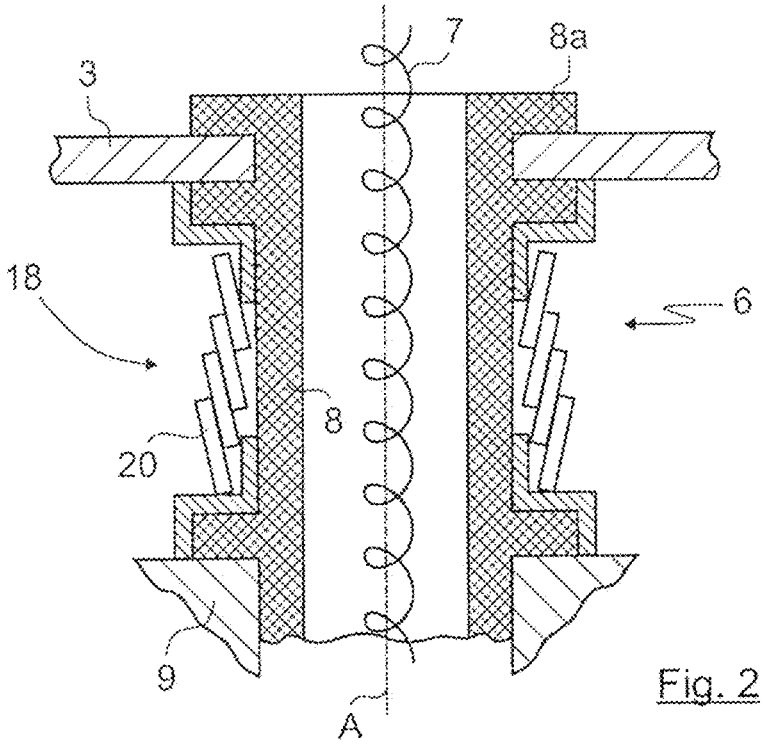
FIG. 2 is a cross-section illustration of the transmission element, having a high-voltage conductor embodied as a spring, which is guided in an insulation element, wherein the shielding element is embodied as an evolute spring.

In FIG. 2, the shielding element 18 has a spring band 20 wound in the form of a sleeve. This can be an evolute spring. According to FIG. 2, an embodiment of the shielding element 18 is also provided such that the connection to the circuit housing 3 or the engine block 9 is shielded accordingly by the shielding element 18, wherein an electrically conductive connection to the spring band 20 is established. This can be a part of the spring band 20, but can also be a metallic sleeve, a metallic coating or the like. In the exemplary embodiment according to FIG. 2, the connection area of the shielding element 18 to the circuit housing 3 or the engine block 9 is embodied as part of the spring band 20 or the evolute spring.

Figure 3:
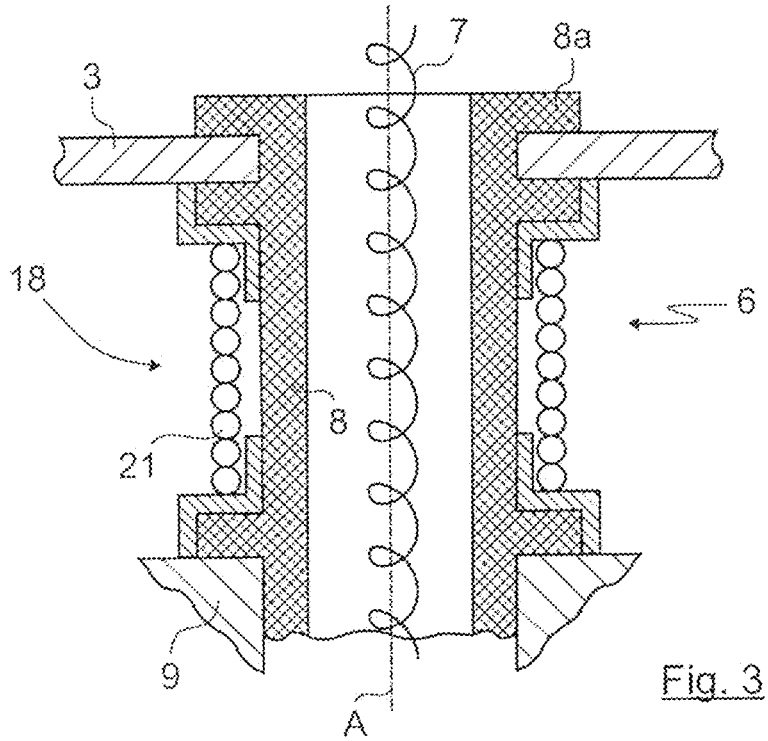
FIG. 3 is a cross-section illustration of the transmission element, having a high-voltage conductor embodied as a spring, which is guided in an insulation element, wherein the shielding element is embodied as a torsion spring.

FIG. 3 shows an embodiment of the shielding element 18 at least partially as a torsion spring 21. The connection to the circuit housing 3 or the engine block 9 can take place similarly to FIG. 2. The connection area is preferably embodied as part of the torsion spring 21.

Figure 4:
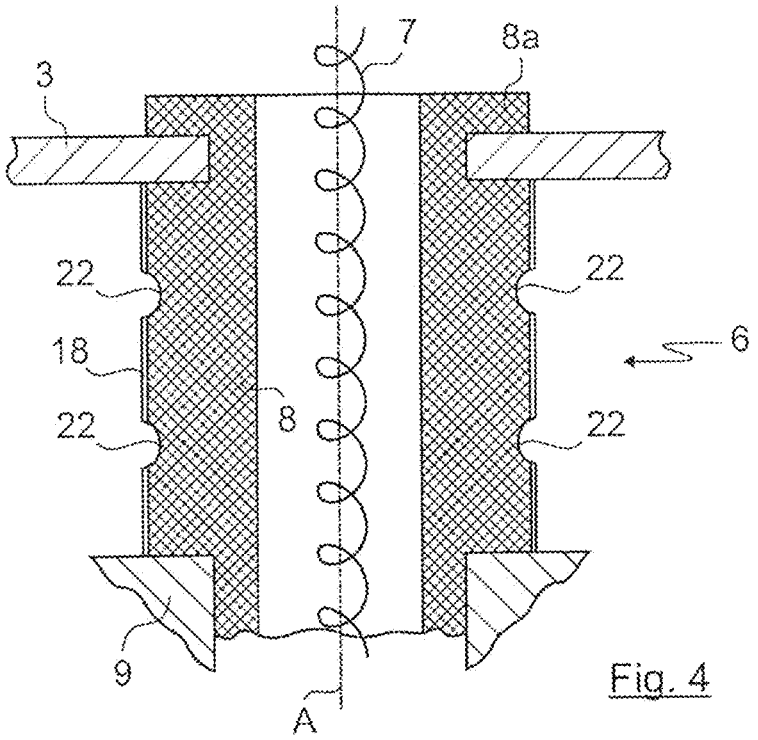
FIG. 4 is a cross-section illustration of the transmission element, having a high-voltage conductor embodied as a spring, which is guided in an insulation element, wherein the shielding element is embodied as a metallic coating of the insulation element.

In FIG. 4, the shielding element 18 is embodied as metallization or a coating of the insulation element 8. In a manner not shown in more detail, it can be provided that the insulation element 8 is completely metallically coated or metallized along the depicted section, in particular between the circuit housing 3 and the engine block 9, so that the metallization or the coating is embodied as a cylinder in a closed circumferential manner. In the exemplary embodiment shown in FIG. 4, however, it is provided that the insulation element 8 has recesses 22 or depressions that are not provided with a metallization or a coating. The coating may be metallic but is not required to be metallic.

It is preferably provided that the recesses 22 do not run around the insulation element 8 in a ring shape, but are only partially ring-shaped so that the electromagnetic shielding is impaired as little as possible and in particular an electrical connection in the axial direction of the shielding element 18 is maintained. The recesses 22 are designed in such a way that the brittleness of the metallization or the metallic coating is reduced when the insulation element 8 moves radially.

As shown in a basic form in FIG. 8, the metallization or the coating of the insulation element 8 can also extend from the circuit housing 3 to the spark plug 10. In this case, too, recesses 22, depressions or general areas can be provided that are not metallized or coated. For example, the metallization can have gaps.

Figure 5:
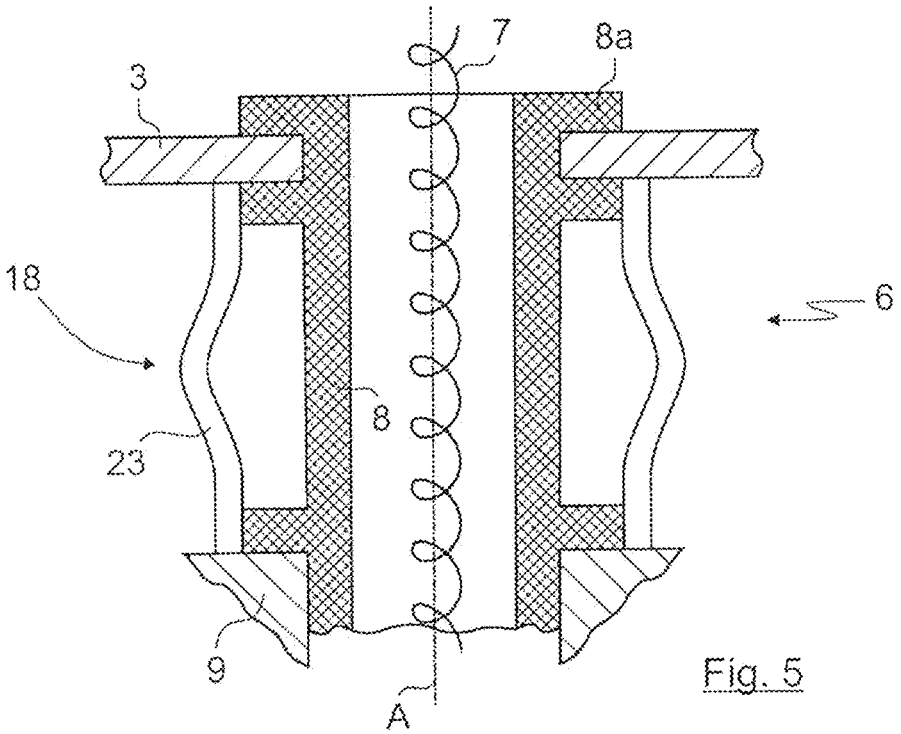
FIG. 5 is a cross-section illustration of the transmission element, having a high-voltage conductor embodied as a spring, which is guided in an insulation element, wherein the shielding element is embodied as a spring cage or spring sleeve.

FIG. 5 shows a configuration in which the shielding element 18 is at least partially embodied as a spring cage 23 or as a spring sleeve. The spring cage 23 can, as shown in FIG. 5, optionally have a "lampion-shaped" form, or a central bulge, which preferably runs completely around in a ring configuration.

Figure 6:
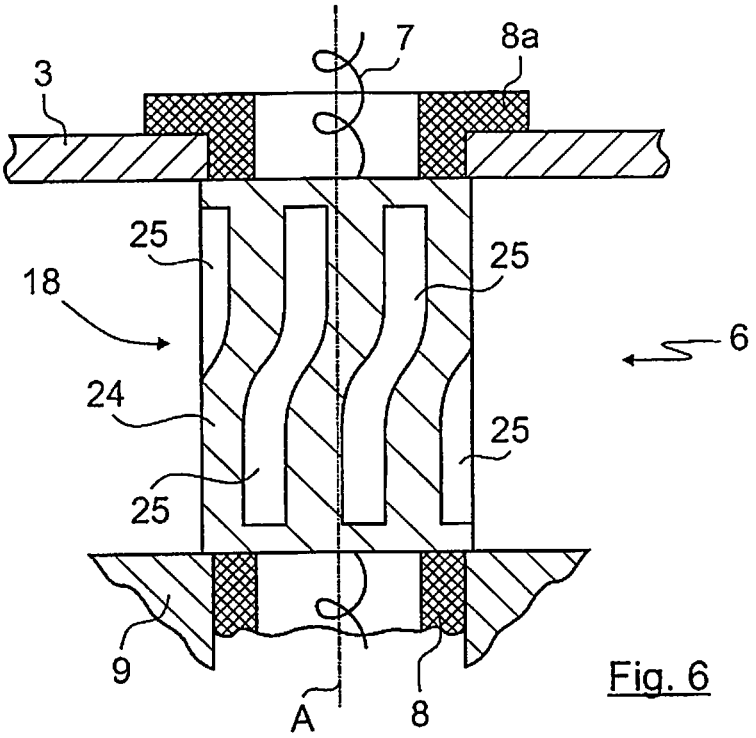
FIG. 6 is a cross-section illustration of the transmission element, having a high-voltage conductor embodied as a spring, which is guided in an insulation element, wherein the shielding element is embodied as a metal sleeve or spring sleeve with recesses.

In the embodiment shown in FIG. 6, it is provided that the shielding element 18 is embodied as a metal sleeve 24. Recesses 25 or punched-out portions are provided, which can preferably extend in the axial direction, preferably in a curved fashion, in order to influence or increase the elasticity of the metal sleeve 24.

Figure 7:
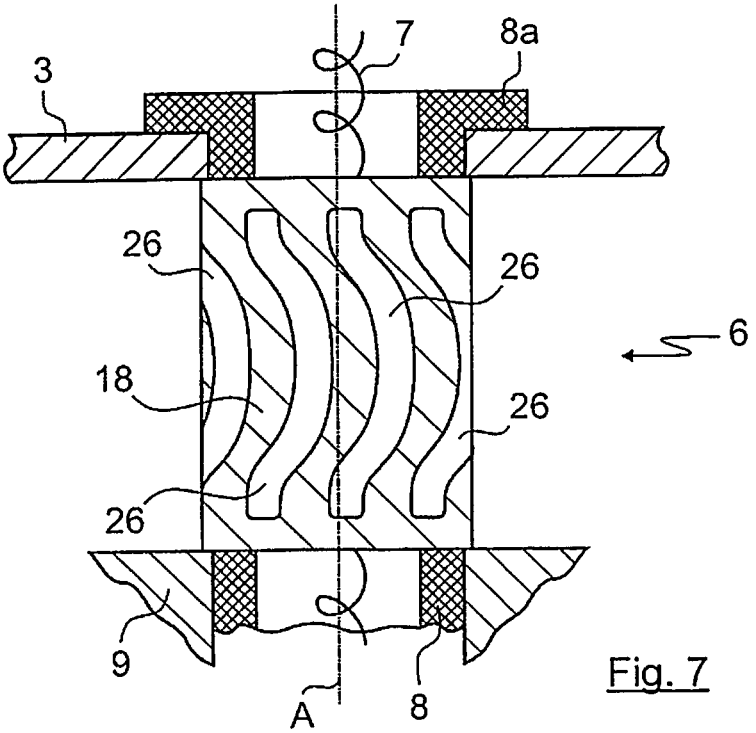
FIG. 7 is a cross-section illustration of the transmission element, having a high-voltage conductor embodied as a spring, which is guided in an insulation element, wherein the shielding element is embodied as a metallic coating with gaps.

FIG. 7 shows an embodiment of the shielding element 18 with a metallization or a coating, the metallization or the coating having gaps 26 in order to influence or increase the elasticity.

The variants of the shielding elements 18 illustrated in FIGS. 2 to 7 can be designed in a suitable manner, in particular in the connection areas to the circuit housing 3 and/or to the engine block 9, or possibly have a different design, which ensures that in this area also there is good shielding against moisture, an electrically conductive connection and/or a seal.

An apparatus for igniting a fuel mixture with an ignition system 1 for generating a high ignition voltage and a circuit device 2, comprising a circuit 4 for superimposing the high ignition voltage with a high-frequency signal and with a spark plug 10 arranged in an engine block 9 and a transmission element 6, comprising a high-voltage conductor 7, which is guided in an insulation element 8, for transmitting the high ignition voltage superimposed with the high-frequency signal to the spark plug 10, wherein an electrically conductive shielding element 18 is provided, which comprises the high-voltage conductor 7 at least along a section of its longitudinal axis A in an electromagnetic shielding manner and wherein the shielding element 18 is electrically conductively connected to a ground potential of the circuit device 2 and the shielding element 18 establishes a connection between the ground potential of the circuit device 2 and a ground electrode 16 of the spark plug 10.

The apparatus, characterized in that the shielding element 18 comprises the insulation element 8 on the outside at least along a section of its longitudinal axis A.

The apparatus, characterized in that the circuit device 2 comprises a circuit housing 3 which electromagnetically shields the circuit 4.

The apparatus, characterized in that the shielding element 18 is connected to a ground potential of the circuit housing 3 and/or to a ground potential of the circuit 4.

The apparatus, characterized in that the ground potential of the circuit 4 is connected to the ground potential of the circuit housing 3.

The apparatus, characterized in that the high-voltage conductor is embodied at least in certain sections as a spring 7.

The apparatus, characterized in that the insulation element 8 is made of rubber or a rubber-like material.

The apparatus, characterized in that the shielding element 18 is formed by metallizing the insulation element 8 and/or as a spring band 20 which is wound in a sleeve shape and/or as a torsion spring 21 and/or as a spring cage 23 and/or as a spring sleeve and/or as a metal sleeve 24.

The apparatus, characterized in that the shielding element 18 extends to the engine block 9 in order to establish an electrical connection between the ground potential of the circuit device 2 and the ground electrode 16 of the spark plug 10 via the engine block 9.

The apparatus, characterized in that the shielding element 18 and/or a ground conductor connected to the shielding element 18 extends to the spark plug 10 in order to establish an electrically conductive connection between the circuit device 2 and the ground electrode 16 of the spark plug 10, directly via the spark plug 10.

A transmission element 6 for transmitting a high ignition voltage from an ignition system 1 to a spark plug 10, having a high-voltage conductor 7 which is guided in an insulation element 8, characterized in that the high-voltage conductor is at least partially embodied as an electrically conductive spring 7 and the transmission element 6 has an electrically conductive shielding element 18 which comprises the spring 7 in an electromagnetic shielding manner at least along a section of its longitudinal axis A, wherein the shielding element 18 is arranged and embodied in such a way that the shielding element 18 comprises at least a portion of the longitudinal axis A of the insulation element 8 on the outside.

The transmission element 6, characterized in that the insulation element 8 is made of rubber or a rubber-like material.

The transmission element 6, characterized in that the shielding element 18 comprises only a section of the longitudinal axis A of the insulation element 8 on the outside or the shielding element 18, starting from a first end 8*a* of the insulation element 8, only comprises a section of the longitudinal axis A of the insulation element 8 on the outside, wherein a ground conductor is continued up to a second end 8*b* of the insulation element 8 facing the spark plug 10 or the shielding element 18 encompasses the insulation element 8 from the first end 8*a* up to the second end 8*b* on the outside.

The transmission element 6, characterized in that the shielding element 18 is at least partially formed by metallization or a coating of the insulation element 8.

The transmission element, characterized in that the insulation element 8 has at least one recess 22 or at least one depression that is not provided with metallization or coating, and/or in that the metallization has gaps 26 so that non-metallized areas are formed on the surface of the insulation material 8.

The transmission element 6, characterized in that the shielding element 18 is at least partially embodied as a spring band 20 which is wound in a sleeve shape.

The transmission element 6, characterized in that the shielding element 18 is at least partially embodied as a torsion spring 21.

The transmission element 6, characterized in that the shielding element 18 is at least partially embodied as a spring cage 23 and/or a spring sleeve.

The transmission element 6 characterized in that the shielding element 18 is at least partially embodied as a closed metal sleeve 24 and/or in that the shielding element 18 is at least partially embodied as a metal sleeve 24 and/or as a spring sleeve with recesses 25.

An ignition device, with an ignition system 1 for generating a high ignition voltage, with a circuit device 2 comprising a circuit 4 for superimposing a high-frequency signal on the high ignition voltage, and with a transmission element 6 in order to transmit the high ignition voltage on which the high-frequency signal is superimposed to a spark plug 10.

A circuit device 2 for superimposing a high-frequency signal on a high ignition voltage, and with a transmission element 6, in order to transmit the high ignition voltage on which the high-frequency signal is superimposed to the spark plug 10.

An apparatus for igniting a fuel mixture, comprising: an ignition system 1 for generating a high ignition voltage; a circuit device 2 having a circuit 4 for superimposing the high ignition voltage with a high-frequency signal; a spark plug 10 having a ground electrode 16 and operatively communicating with an engine block 9; a transmission element 6 which is guided in an insulation element 8, the transmission element 6 encompassing a high-voltage conductor 7 for transmitting the high ignition voltage, superimposed with the high-frequency signal, to the spark plug 10, and wherein an electrically conductive shielding element 18 is provided, and the electrically conductive shielding element 18 encompasses the high-voltage conductor 7 at least along a section of the high-voltage conductor longitudinal axis A in an electromagnetic shielding manner; and wherein the electrically conductive shielding element 18 is electrically conductively connected to a ground potential of the circuit device 2; and the electrically conductive shielding element 18 establishes an electrical connection between the ground potential of the circuit device 2 and the ground electrode 16 of the spark plug 10.

An apparatus wherein the electrically conductive shielding element 18 encompasses the insulation element 8 on the outside of the high-voltage conductor 7 at least along a section of the high-voltage conductor 7 longitudinal axis A.

An apparatus further comprising: a circuit housing 3 which electromagnetically shields the circuit 4.

An apparatus wherein the electrically conductive shielding element 18 is connected to at least one of a ground potential of the circuit housing 3 and a ground potential of the circuit 4.

An apparatus wherein the ground potential of the circuit 4 is connected to the ground potential of the circuit housing 3.

An apparatus wherein the high-voltage conductor 7 is a spring 20.

An apparatus wherein the insulation element 8 is made of at least one of rubber and a rubber-like material.

An apparatus wherein the electrically conductive shielding element 18 is formed by metallizing the insulation element 8.

An apparatus wherein the electrically conductive shielding element 18 extends to the engine block 9 to establish an electrical connection between the ground potential of the circuit device 2 and the ground electrode 16 of the spark plug 10 via the engine block 9.

An apparatus wherein at least one of the electrically conductive shielding element 18 and a ground conductor connected to the electrically conductive shielding element 18 extend to the spark plug 10 to establish an electrically conductive connection between the circuit device 2 and the ground electrode 16 of the spark plug 10 via the spark plug 10.

A transmission element 6 for transmitting a high ignition voltage from an ignition system 1 to a spark plug, comprising: a high-voltage conductor 7 which is guided in an insulation element 8 and wherein the high-voltage conductor 7 is at least partially an electrically conductive spring 20 that has a longitudinal axis A; an electrically conductive shielding element 18 which encompasses the electrically conductive spring 7 in an electromagnetic shielding manner along a section of the electrically conductive spring's 20 longitudinal axis A; and wherein the electrically conductive shielding element 18 is arranged and embodied so that the electrically conductive shielding element 18 encompasses at least a portion of a longitudinal axis A of the insulation element 8 and on an outside of the insulation element 8.

A transmission element 6 wherein the insulation element 8 is made of at least one of rubber and a rubber-like material.

A transmission element 6 wherein the electrically conductive shielding element 18 encompasses only a section of the longitudinal axis A of the insulation element 8 on the outside or the electrically conductive shielding element 18, and starting from a first end 8*a* of the insulation element 8.

A transmission element 6 wherein the electrically conductive shielding element 18 is at least partially formed by metallization of the insulation element 8 or a coating of the insulation element 8.

A transmission element 6 wherein the insulation element 8 has at least one recess 22 or at least one depression that is not metalized or coated, so that at least one of non-metallized/non-coated recesses/depressions are formed on the surface of the insulation element 8.

A transmission element 6 wherein the electrically conductive shielding element 18 is at least partially a spring band 20 which is wound in a sleeve shape.

A transmission element 6 wherein the electrically conductive shielding element 18 is at least partially a torsion spring 21.

A transmission element 6 wherein the electrically conductive shielding element 18 is at least partially a spring cage 23 and/or a spring sleeve 25.

A transmission element 6 wherein the electrically conductive shielding element 18 is at least partially a closed metal sleeve 24.

An ignition device 1 for generating a high ignition voltage, comprising: a circuit device having a circuit 4 for superimposing a high-frequency signal on the high ignition voltage; and a transmission element 6 to transmit the high ignition voltage on which the high-frequency signal is superimposed to a spark plug 10.

A circuit device 2 for superimposing a high-frequency signal on a high ignition voltage, comprising: a transmission element 6 that has, a high-voltage conductor 7 which is guided in an insulation element 8, and wherein the high-voltage conductor 7 is an electrically conductive spring 20 that has a longitudinal axis A, and an electrically conductive shielding element 18 which encompasses the electrically conductive spring 20 in an electromagnetic shielding manner along a section of the electrically conductive spring's 20 longitudinal axis A, and wherein the electrically conductive shielding element 18 encompasses at least a portion of a longitudinal axis A of the insulation element 8 and on an outside of the insulation element 8; and the high-voltage conductor 7 transmits the high ignition voltage on which the high-frequency signal is superimposed to the spark plug 10.

The apparatus wherein the electrically conductive shielding element 18 is a spring band 20.

The apparatus wherein the electrically conductive shielding element 18 is wound in a sleeve shape.

The apparatus wherein the electrically conductive shielding element 18 is wound in as a torsion spring 21.

The apparatus wherein the electrically conductive shielding element 18 is formed by metallizing the insulation element 8 and may be in the form of a spring cage 23.

The apparatus wherein the electrically conductive shielding element 18 is a spring sleeve 24, and may further be in the form of a metal sleeve.

The transmission element 6 wherein the electrically conductive shielding element 18 encompasses only a section of the longitudinal axis A of the insulation element 8 on the outside of the insulation element 8, and wherein a ground conductor is continued up to a second end 8*b* of the insulation element 8 proximate to the spark plug 10.

The transmission element 6 wherein the electrically conductive shielding element 18 encompasses the insulation element 8 from a first end 8*a* up to a second end 8*b* on the outside of the insulation element 8.

The transmission element 6 wherein the electrically conductive shielding element 18 is at least partially at least one of a metal sleeve 24 and a spring sleeve with recesses 25.

Having described our Apparatus for igniting a fuel mixture, transmission element for transmitting a high-voltage ignition voltage, ignition device and circuit device, we respectfully request issuance of US utility letters patent.

We claim:

1. An apparatus for igniting a fuel mixture, comprising:

an ignition system for generating a high ignition voltage;

a circuit device having a circuit for superimposing the high ignition voltage with a high-frequency signal;

a spark plug located within a shaft defined within an engine block, the spark plug having a ground electrode operatively communicating with the engine block;

a transmission element which is guided in an insulation element, the transmission element encompassing a high-voltage conductor for transmitting the high ignition voltage, superimposed with the high-frequency signal, to the spark plug, and wherein an electrically conductive shielding element is provided, and the electrically conductive shielding element encompasses the high-voltage conductor at least along a section of the high-voltage conductor longitudinal axis in an electromagnetic shielding manner; and wherein the electrically conductive shielding element is electrically conductively connected to a ground potential of the circuit device; and the electrically conductive shielding element establishes an electrical connection between the ground potential of the circuit device and the ground electrode of the spark plug; and wherein at least one of the electrically conductive shielding element and/or a ground conductor connected to the electrically conductive shielding element extends to the spark plug to establish an electrically conductive connection between the circuit device and the ground electrode of the spark plug via the spark plug; and wherein the high voltage conductor is at least partially embodied as an electrically conductive spring.

2. The apparatus as claimed in claim 1 and wherein the electrically conductive shielding element encompasses the insulation element on the outside of the high-voltage conductor at least along a section of the high-voltage conductor longitudinal axis.

3. The apparatus as claimed in claim 1 and further comprising:

a circuit housing which electromagnetically shields the circuit.

4. The apparatus as claimed in claim 3 and wherein, the electrically conductive shielding element is connected to at least one of a ground potential of the circuit housing or a ground potential of the circuit.

5. The apparatus as claimed in claim 4 and wherein the ground potential of the circuit is connected to the ground potential of the circuit housing.

6. The apparatus as claimed in claim 1 and wherein, the high-voltage conductor is a spring.

7. The apparatus as claimed in claim 1 and wherein the insulation element is made of at least one of rubber or a rubber-like material.

8. The apparatus as claimed in claim 1 and wherein the electrically conductive shielding element is formed by metallizing the insulation element.

9. The apparatus as claimed in claim 1 and wherein the electrically conductive shielding element extends to the engine block to establish an electrical connection between the ground potential of the circuit device and the ground electrode of the spark plug via the engine block.

10. A transmission element for transmitting a high ignition voltage from an ignition system to a spark plug, comprising:

a high-voltage conductor which is guided in an insulation element, and wherein the high-voltage conductor is at least partially an electrically conductive spring that has a longitudinal axis;

an electrically conductive shielding element which encompasses the electrically conductive spring in an electromagnetic shielding manner along a section of the electrically conductive spring's longitudinal axis; and wherein the electrically conductive shielding element is arranged and embodied so that the electrically conductive shielding element encompasses at least a portion of a longitudinal axis of the insulation element and on an outside of the insulation element; and wherein the electrically conductive shielding element is at least partially formed by metallization of the insulation element or a coating of the insulation element; and wherein the insulation element has at least one recess or at least one depression that is not metalized or coated, so that at least one of non-metallized/non-coated recesses/depressions are formed on the surface of the insulation element.

11. The transmission element as claimed in claim 10 and wherein the electrically conductive shielding element is at least partially a spring band which is wound in a sleeve shape.

12. The transmission element as claimed in claim 10 and wherein the electrically conductive shielding element is at least partially a torsion spring.

13. The transmission element as claimed in claim 10 and wherein the electrically conductive shielding element is at least partially a spring cage.

14. The transmission element as claimed in claim 10 and wherein the electrically conductive shielding element is at least partially a closed metal sleeve.

15. An ignition device for generating a high ignition voltage, comprising:

a circuit device having a circuit for superimposing a high-frequency signal on the high ignition voltage; and a transmission element to transmit the high ignition voltage on which the high-frequency signal is superimposed to a spark plug, the transmission element having a high-voltage conductor which is guided in an insulation element, and wherein the high-voltage conductor is at least partially an electrically conductive spring that has a longitudinal axis;

an electrically conductive shielding element which encompasses the electrically conductive spring in an electromagnetic shielding manner along a section of the electrically conductive spring's longitudinal axis; and wherein the electrically conductive shielding element is arranged and embodied so that the electrically conductive shielding element encompasses at least a portion of a longitudinal axis of the insulation element and on an outside of the insulation element; and wherein the electrically conductive shielding element is at least partially formed by metallization of the insulation element or a coating of the insulation element; and wherein the insulation element has at least one recess or at least one depression that is not metalized or coated, so that at least one of non-metallized/non-coated recesses/depressions are formed on the surface of the insulation element.

16. A circuit device for superimposing a high-frequency signal on a high ignition voltage, comprising:

a transmission element that has, a high-voltage conductor which is guided in an insulation element, and wherein the high-voltage conductor is an electrically conductive spring that has a longitudinal axis, and an electrically conductive shielding element which encompasses the electrically conductive spring in an electromagnetic shielding manner along a section of the electrically conductive spring's longitudinal axis, and wherein the electrically conductive shielding element encompasses at least a portion of a longitudinal axis of the insulation element and on an outside of the insulation element; and wherein the electrically conductive shielding element is at least partially formed by metallization of the insulation element or a coating of the insulation element; and wherein the insulation element has at least one recess or at least one depression that is not metalized or coated, so that at least one of non-metallized/non-coated recesses/depressions are formed on the surface of the insulation element; and the high-voltage conductor transmits the high ignition voltage on which the high-frequency signal superimposed to the spark plug.

17. The apparatus as claimed in claim 1 and wherein the electrically conductive shielding element is a spring band.

18. The apparatus as claimed in claim 1 wherein the electrically conductive shielding element is wound in a sleeve shape.

19. The apparatus as claimed in claim 1 wherein the electrically conductive shielding element is wound in as a torsion spring.

20. The apparatus as claimed in claim 1 and wherein the electrically conductive shielding element is formed by metallizing the insulation element and is a spring cage.

21. The apparatus as claimed in claim 1 and wherein the electrically conductive shielding element is a spring sleeve.

22. The apparatus as claimed in claim 1 wherein the electrically conductive shielding element is a metal sleeve. insulation element, and wherein a ground conductor is continued up to a second end of the insulation element proximate to the spark plug.

23. The transmission element as claimed in claim 10 and wherein the electrically conductive shielding element encompasses only a section of the longitudinal axis of the insulation element on the outside of the insulation element, and wherein a ground conductor is continued up to a second end of the insulation element proximate to the spark plug.

24. The transmission element as claimed in claim 10 and wherein the electrically conductive shielding element encompasses the insulation element from a first end up to a second end on the outside of the insulation element.

25. The transmission element as claimed in claim 10 and wherein the electrically conductive shielding element is at least partially at least one of a metal sleeve and a spring sleeve with recesses.

26. The apparatus as claimed in claim 1 and wherein the electrically conductive shielding element is a spring cage.

27. The transmission element as claimed in claim 10 and wherein the insulation element is made of at least one of rubber or a rubber-like material.

28. The transmission element as claimed in claim 10 and wherein the electrically conductive shielding element encompasses only a section of the longitudinal axis of the insulation element on the outside of the electrically conductive shielding element, and starting from a first end of the insulation element.

* * * * *